US010920372B2

(12) United States Patent
Tachibana et al.

(10) Patent No.: US 10,920,372 B2
(45) Date of Patent: Feb. 16, 2021

(54) METHOD FOR SEPARATING CELLULOSE

(71) Applicant: EARTHRECYCLE CO., LTD., Hyogo (JP)

(72) Inventors: Takashi Tachibana, Hyogo (JP); Kenichi Hamada, Hyogo (JP)

(73) Assignee: EARTHRECYCLE CO., LTD., Hyogo (JP)

( * ) Notice: Subject to any disclaimer, the term of this patent is extended or adjusted under 35 U.S.C. 154(b) by 80 days.

(21) Appl. No.: 16/183,138

(22) Filed: Nov. 7, 2018

(65) Prior Publication Data

US 2019/0136448 A1 May 9, 2019

(51) Int. Cl.

| | |
|---|---|
| ***D21C 3/20*** | (2006.01) |
| ***D21C 3/00*** | (2006.01) |
| ***D21C 9/04*** | (2006.01) |
| ***D21H 11/14*** | (2006.01) |
| ***D21H 11/12*** | (2006.01) |
| ***D21C 9/12*** | (2006.01) |
| ***D21C 11/00*** | (2006.01) |
| ***D21C 9/18*** | (2006.01) |
| ***D21C 9/02*** | (2006.01) |
| ***D21C 5/00*** | (2006.01) |
| ***D21C 9/10*** | (2006.01) |

(52) U.S. Cl.

CPC ..... *D21C 3/20* (2013.01); *D21C 3/003* (2013.01); *D21C 5/00* (2013.01); *D21C 9/02* (2013.01); *D21C 9/04* (2013.01); *D21C 9/10* (2013.01); *D21C 9/12* (2013.01); *D21C 9/18* (2013.01); *D21C 11/0007* (2013.01); *D21H 11/12* (2013.01); *D21H 11/14* (2013.01)

(58) Field of Classification Search

CPC ..... D21C 3/20; D21C 3/003

See application file for complete search history.

(56) References Cited

U.S. PATENT DOCUMENTS

| | | | | |
|---|---|---|---|---|
| 2,772,968 A * | 12/1956 | Grondal | ..... | D21C 3/20 162/77 |
| 3,887,426 A * | 6/1975 | Fogarassy | ..... | D21C 3/20 162/29 |
| 4,017,642 A * | 4/1977 | Orth, Jr. | ..... | D21C 3/20 426/69 |

FOREIGN PATENT DOCUMENTS

| | | |
|---|---|---|
| JP | 2006-075007 A | 3/2006 |
| JP | 2006-136263 A | 6/2006 |

(Continued)

*Primary Examiner* — Anthony Calandra

(74) *Attorney, Agent, or Firm* — IP Business Solutions, LLC

(57) ABSTRACT

A method for separating cellulose from a wood-based raw material including hemicellulose, cellulose, and lignin as principal components, includes injecting the wood-based raw material into a dissolution reservoir in which ethylene glycol is stored as a separating agent, and heating the separating agent in the dissolution reservoir at atmospheric pressure to a temperature in a range of 260° C. to 280° C., and reacting the wood-based raw material with the separating agent, evaporating a hemicellulose component from the separating agent and condensing the hemicellulose component, and monitoring a pH value of the condensate of the hemicellulose component. A temperature of the condensate is held at the temperature at which a change in the pH value of the condensate decreases, lignin is dissolved in the separating agent, and crude cellulose that floats in the separating agent is separated and collected.

4 Claims, 4 Drawing Sheets

(56) References Cited

FOREIGN PATENT DOCUMENTS

| | | | |
|---|---|---|---|
| JP | 2006-149343 | A | 6/2006 |
| JP | 2007-202518 | A | 8/2007 |
| JP | 2008-043328 | A | 2/2008 |
| JP | 2010-094095 | A | 4/2010 |
| JP | 2011-041493 | A | 3/2011 |
| JP | 2011-101608 | A | 5/2011 |

* cited by examiner

METHOD FOR SEPARATING CELLULOSE

CROSS-REFERENCE TO THE RELATED APPLICATION

This application claims foreign priority to Japanese Patent Application filed on Nov. 2, 2017.

BACKGROUND OF THE INVENTION

Field of Invention

The present Invention relates to a method for separating cellulose and in particularly, to a method in which hemicellulose, cellulose and lignin are separated and cellulose is collected in an efficient manner within a short period of time, furthermore, without using an acid or an alkali.

Description of Related Art

Recently, techniques for effectively using wood-based biomass energy such as wood as petroleum-replacing energy have been attracting attention. In addition to the use of woods as materials or fuels, the use of components such as cellulose, hemicellulose and lignin has been proposed.

It is proposed a method for producing sugar content or bioethanol from cellulose or hemicellulose in a wood raw material.

Specifically, it is proposed methods for producing sugar content or ethanol by means of a hydrolysis using an acid as a principal saccharification process (Patent Document 1 and Patent Document 2).

In addition, it is proposed methods for producing sugar content or ethanol by carrying out a mechanical miniaturization treatment and/or a delignification treatment by a chemical treatment of an acid, an alkali, hydrogen peroxide, chlorite, or the like singly or in combination ahead of or in the middle of enzymic saccharification (Patent Documents 3 to 5).

Furthermore, it is proposed a method for producing sugar using a non-sulfate and non-enzyme method in which a hydrolysis (saccharification) is carried out using a solid acid catalyst after solubilization by an alkali treatment in sodium hydroxide or ammonia and a lignin decomposition treatment using chlorine or sodium hypochlorite (Patent Document 6).

In addition, it is proposed methods in which, before an enzymic saccharification treatment, a pretreatment by a combination of a hot compressed water treatment and a mechanical miniaturization treatment or a pretreatment in which a raw material is immersed in a carbon dioxide-dissolved water under heating and pressurization is carried out, thereby producing sugar content or ethanol without using an acid, an alkali, and other chemicals (Patent Document 7 and Patent Document 8).

RELATED ART DOCUMENT

Patent Document

Patent Document 1: JP-A-2006-075007
Patent Document 2: JP-A-2007-202518
Patent Document 3: JP-A-2008-043328
Patent Document 4: JP-A-2011-041493
Patent Document 5: JP-A-2006-149343
Patent Document 6: JP-A-2011-101608

Patent Document 7: JP-A-2006-136263
Patent Document 8: JP-A-2010-094095

SUMMARY OF THE INVENTION

Technical Problem

However, as the methods described in Patent Documents 1 to 6 use an acid, an alkali or other chemicals, process are cumbersome, facility corrosion, waste liquid treatments and the like are troublesome, and products generated due to neutralization become industrial waste.

In addition, as the methods described in Patent Documents 6 and 7 employ a hot compressed water treatment or a mechanical miniaturization treatment, the energy consumption amount is great.

Furthermore, for the methods described in Patent Documents 1 to 8, the delignification effect is limited, and thus there is a limitation on the efficiency of producing sugar content or ethanol from cellulose or hemicellulose.

Meanwhile, the content of lignin in wood-based biomass is generally approximately 30% in needle-leaved trees and approximately 20% to 25% in broadleaf trees. However, for the methods described in Patent Documents 1 to 8, during the saccharification treatment, approximately half of components that are not saccharificated such as lignin and cellulose buried in lignin remain as residues, which nullifies the saccharification treatment.

Furthermore, the residual components easily corrode, and thus, in order to effectively use the wood-based biomass, the separation, drying or the like of the residues from a sugar solution is necessary, which requires a significant amount of energy and cost.

An object of the present Invention is to provide a method for separating cellulose in which cellulose is efficiently separated and collected within a short period of time without using an acid or an alkali.

Solution to Problem

According to the present Invention, there is provided a method for separating cellulose from a wood-based raw material including hemicellulose, cellulose and lignin as principal components, in which the wood-based raw material is injected into a dissolution reservoir in which ethylene glycol is stored as a separating agent, and the separating agent in the dissolution reservoir is heated at normal pressure to a temperature in a range of 260° C. to 280° C., and the wood-based raw material is reacted with the separating agent, a hemicellulose component that evaporates from the separating agent is condensed, a pH value of a condensate which changes from an acid value to a neutral value as a temperature of the separating agent increases is monitored, a temperature of the condensate is held at a temperature at which a change in the pH value of the condensate decreases, lignin is dissolved in the separating agent, and crude cellulose that floats in the separating agent is separated and collected.

One of characteristics of the present Invention is to use ethylene glycol as the separating agent, heat the wood-based raw material injected into the separating agent to a predetermined high temperature in the dissolution reservoir, condense the hemicellulose component that evaporates from the separating agent, monitor the pH of the condensate which changes from a strong acid value to the neutral value as the temperature increases, hold the condensate at a temperature at which the pH becomes substantially constant, separate a lignin component of the wood-based raw material on a reservoir bottom as a solid content, and separate and collect the cellulose component that floats in the separating agent.

Therefore, it is possible to efficiently separate hemicellulose, cellulose and lignin from the wood-based raw material, and furthermore the pH of the condensate which changes from an acid value to the neutral value (or an alkaline value) as the temperature increases is monitored, and the separating agent in the dissolution reservoir is held at a temperature at which the pH of the separating agent in the dissolution reservoir becomes substantially constant, and thus it is possible to efficiently separate cellulose within a short period of time.

Furthermore, since ethylene glycol is used, and an acid or an alkali is not used, the safety is excellent, and no environmental issues are caused.

Furthermore, general-purpose apparatuses such as a dissolution reservoir and a vacuum evaporation reservoir are used, the apparatuses are simple and excellent in terms of operability, and a special facility is not required.

As the ethylene glycol, it is possible to use ethylene glycol or tri-ethylene glycol.

As the wood-based raw material, it is possible to use woodfibers made of one or more selected from the group consisting of bamboo, wood, and wood cotton, food fibers made of one or more selected from the group consisting of vegetable, fruit, and cereal, or recycled fibers made of cotton or pulp. In a case in which the wood-based raw material is bamboo, wood, wood cotton, cotton, or the like, hemicellulose is included in the raw material component; however, in the case of marijuana, hemicellulose is not included in the raw material component, and thus marijuana is treated together with the wood-based raw material including a hemicellulose component. When hemicellulose is evaporated from the dissolution reservoir and condensed, it is possible to obtain hemicellulose in a hemicellulose liquid form.

DETAILED DESCRIPTION OF THE PREFERRED EMBODIMENTS

Figure 1:
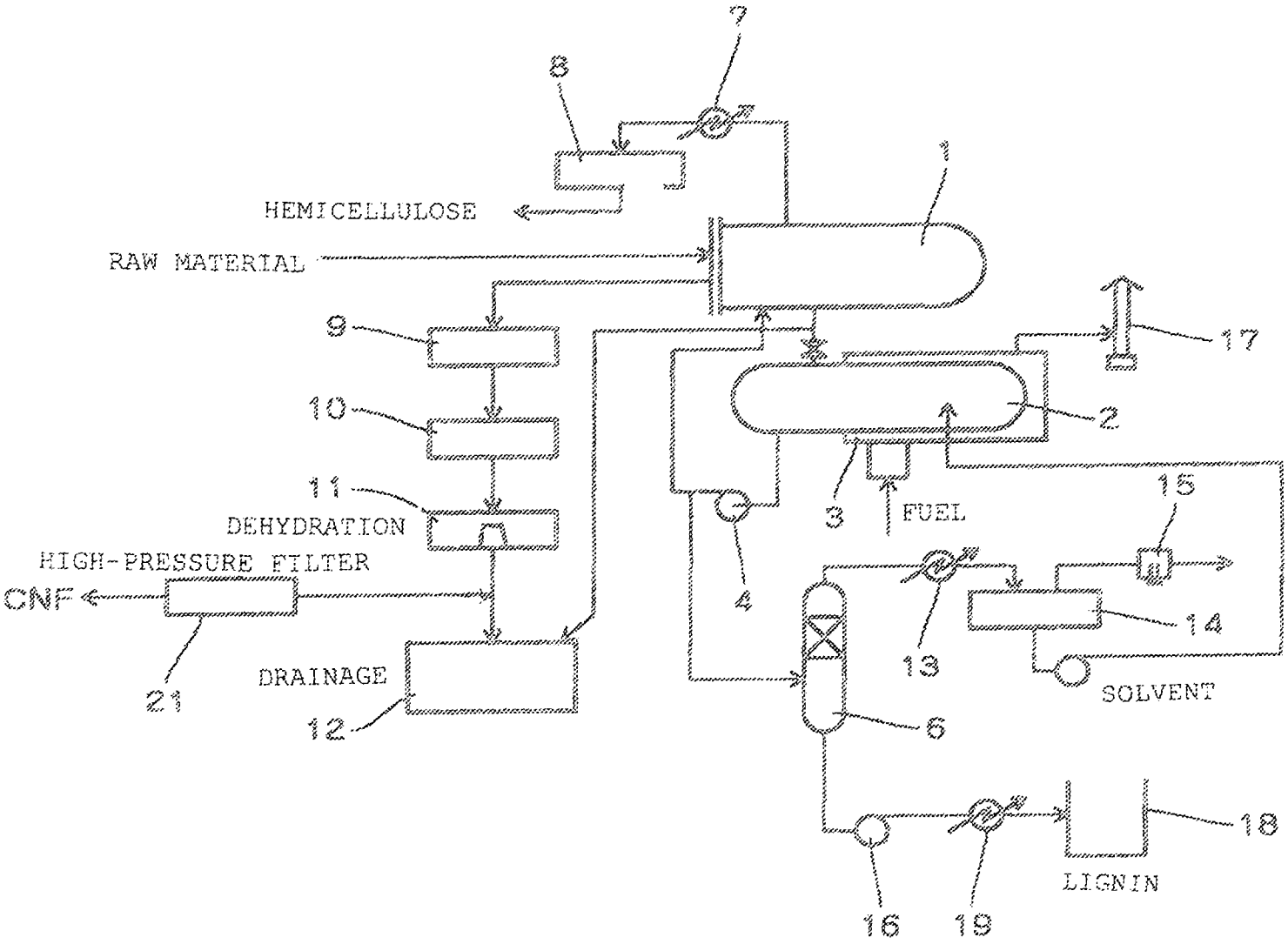
FIG. 1 is a configuration view of a system illustrating a preferred embodiment of a method for separating cellulose of the present Invention.
Figure 2:
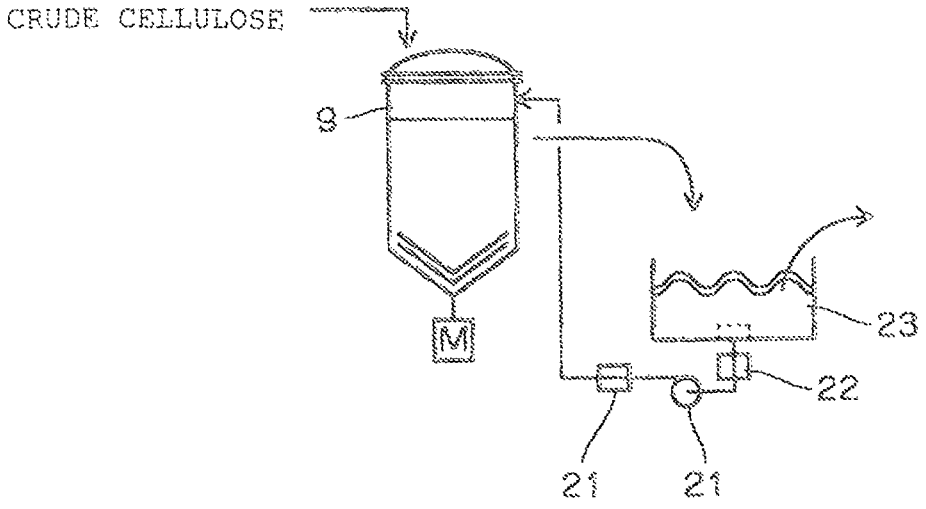
FIG. 2 is a view illustrating an example of a system that washes and miniaturizes crude cellulose in the embodiment.

Hereinafter, the present Invention will be described in detail on the basis of specific examples illustrated in drawings. FIG. 1 and FIG. 2 illustrate a preferred embodiment of a method for separating cellulose of the present invention. In the drawings, a dissolution reservoir 1 stores tri-ethylene glycol (TEG) as a separating agent therein.

In the dissolution reservoir 1, the separating agent is heated to a temperature in a range of 260° C. to 280° C. in a state in which one or more wood-based raw materials selected from the group consisting of bamboo, wood, wood cotton, and cotton are injected therein and held for 0.5 to 1.5 hours, hemicellulose evaporates as the temperature increases, lignin dissolves in the separating agent, the separating agent including lignin is extracted, and crude cellulose that floats on the separating agent remains on the reservoir bottom and is collected. Meanwhile, as the raw material, it is also possible to use vegetable, fruit, and cereal (food fibers) or pulp (recycled fibers).

A condenser 7 that condenses the hemicellulose component that evaporates from the separating agent is connected to the dissolution reservoir 1, the condensed hemicellulose is received in a condensation reservoir 8, and the pH thereof is monitored.

In addition, the separating agent extructed from the reservoir bottom of the dissolution reservoir 1 is received in a receiving reservoir 2 and heated using a heating furnace 3, the heated separating agent is sent out using a circulation pump 4, a part thereof is circulated to the dissolution reservoir 1, and the separating agent in the dissolution reservoir 1 is heated.

The remainder of the separating agent that is circulated using the circulation pump 4 is sent to a vacuum evaporation reservoir 6, the separating agent is evaporated in a vacuum, lignin is separated on the reservoir bottom of the vacuum evaporation reservoir 6, and lignin is transferred using a transfer pump 16, condensed using a condenser 19, and received in a receiving reservoir 18. A chimney 17 is a chimney of a heating furnace 3.

The vacuum-evaporated separating agent is condensed using a condenser 13, received in a receiving reservoir 14 in which a negative pressure is formed using a vacuum pump 15, and returned to the separating agent-receiving reservoir 2 using a pump 20.

Meanwhile, the crude cellulose that remains on the reservoir bottom of the dissolution reservoir 1 as a solid content is washed, cooled, and then extracted from the dissolution reservoir 1, a fiber is cut and washed in a rotary cutting water reservoir 9 and thus becomes fine cellulose, the fine cellulose is bleached in a bleaching reservoir 10, furthermore, dehydrated in a centrifugal separator 11, and then, pressurized mechanically, for example, using a high-pressure filter 21, and miniaturized, that is, turned into a cellulose nanofiber (CNF), the cellulose nanofiber is removed, and discharged water is treated using a treatment facility 12.

Here, the separation method will be described. In the dissolution reservoir 1, when the liquid temperature of the separating agent reaches a temperature in a range of 200° C. to 260° C., for example, 200° C., the hemicellulose component begins to evaporate, and the pH of a condensate thereof indicates a strong acidity. The pH of the condensate increases until 260° C. and reaches 5 to 6 at 275° C., the amount of the hemicellulose component distilled away decreases, when fractional distillation stops, the heating is stopped, and the condensate is held to stand at the temperature for 0.5 to 1.5 hours.

Next, the separating agent in the dissolution reservoir 1 is extracted from the reservoir bottom, and then, the solid content (the crude cellulose) in the dissolution reservoir 1 is washed, cooled, and fed into the rotary cutting water reservoir 9, the crude cellulose is washed using a rotating stirring blade and cut to be fine cellulose, then, as illustrated in FIG. 2, the fine cellulose is extracted from the rotary cutting water reservoir 9 using a transfer pump 21, filtered using a filter 20, separated using a strainer 22, and received in a receiving reservoir 23. After that, the fine cellulose is immersed and bleached in an aqueous solution of hypochlorous acid and caustic soda in the bleaching reservoir 10, and it is possible to further miniaturize the fine cellulose.

Meanwhile, the liquid extracted from the dissolution reservoir 1 is colored to a dark brown color, when the liquid is evaporated and gasified in the vacuum evaporation reservoir 6, it is possible to collect pressure-sensitive adhesivelike lignin on the reservoir bottom, when the evaporated and gasified vapor is condensed, it is possible to collect and reuse the separating agent.

The yield was 24 wt % (the temperature of the dissolution reservoir: 275° C. or lower) for hemicellulose, 49 wt % (the temperature of the dissolution reservoir: 275° C. or lower) for cellulose, 14 wt % for lignin, and 13 wt % for others.

Figure 3:
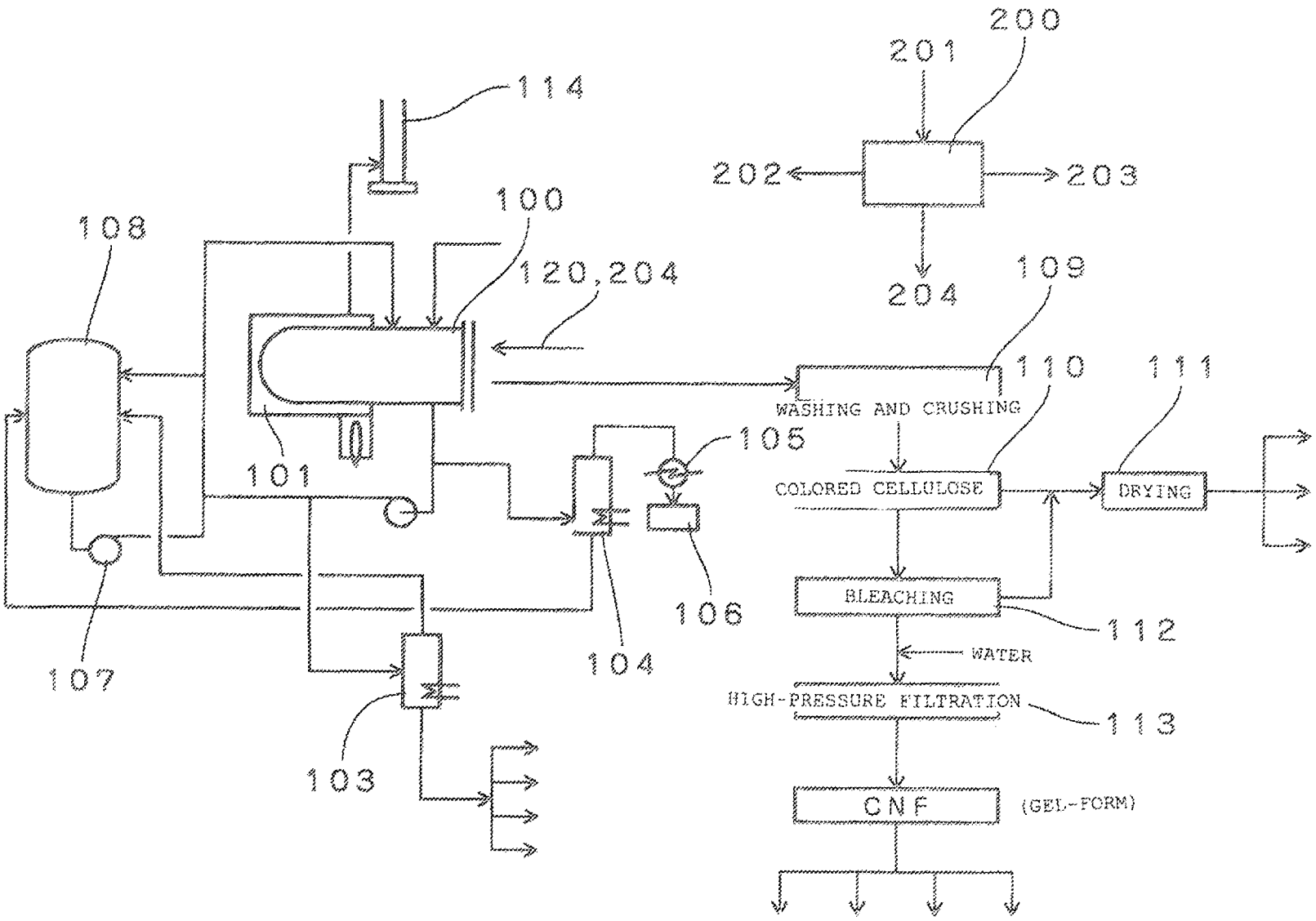
FIG. 3 is a view illustrating a second embodiment.

FIG. 3 illustrates a second embodiment. In the present example, a facility that separates cotton derived from an old cloth as a wood-based raw material is further provided. In the drawing, an old cloth-separating reservoir 20 stores ethylene glycol or tri-ethylene glycol therein a separating agent, and when an old cloth 201 made of a fiber of polyester, cotton, nylon, acryl, and the like as a material is injected into the separating agent in the old cloth-separating reservoir 20, and the separating agent is heated to 200° C. to 280° C., cotton 204 floats on the separating agent, polyester, nylon, and acryl are dissolved in the separating agent, and buttons or clasps sink on the reservoir bottom and are separated.

In a dissolution reservoir 100, tri-ethylene glycol (TEG) is stored as a separating agent and heated using a heating furnace 101. A chimney 114 is the chimney of the heating furnace 101. In the dissolution reservoir 100, in addition to a wood-based raw material 120 such as bamboo, wood, marijuana, wood cotton, or cotton, the cotton 204 derived from an old cloth is also injected into the separating agent, the separating agent is heated up to a temperature in a range of 260° C. to 280° C., for example, 275° C. that is a temperature at which hemicellulose dissolves and held for 0.5 to 1.5 hours, crude cellulose is left as a solid content on the reservoir bottom, lignin dissolves in the separating agent, and the separating agent including lignin is withdrawn.

The dissolution reservoir 100 is configured that the separating agent in which lignin is dissolved can be extracted from the reservoir bottom, the extracted separating agent is transferred using a pump 102, a part thereof is received in a receiving reservoir 108, and the remainder is sent to a lignin-separating tower 103, the separating agent is evaporated in a vacuum, lignin is separated, the evaporated separating agent is condensed, returned to the receiving reservoir 108, and circulated to the dissolution reservoir 100 using a circulation pump 107.

In addition, from the separating agent extracted from the dissolution reservoir 100, moisture is evaporated and separated in a water-separating tower 104, the separating agent is returned to the receiving reservoir 108, and the separated moisture is condensed and retained in a tank 106.

The crude cellulose remaining as the solid content on the reservoir bottom of the dissolution reservoir 100 is washed and cooled using a washing water 121, and then extracted from the dissolution reservoir 100, a fiber is cut and washed in a rotary cutting water reservoir 109, bleached in a bleaching reservoir 102, furthermore, miniaturized, washed, and filtered using a high-pressure filter 113, thereby obtaining a gel-form cellulose nanofiber (CNF).

Figure 4:
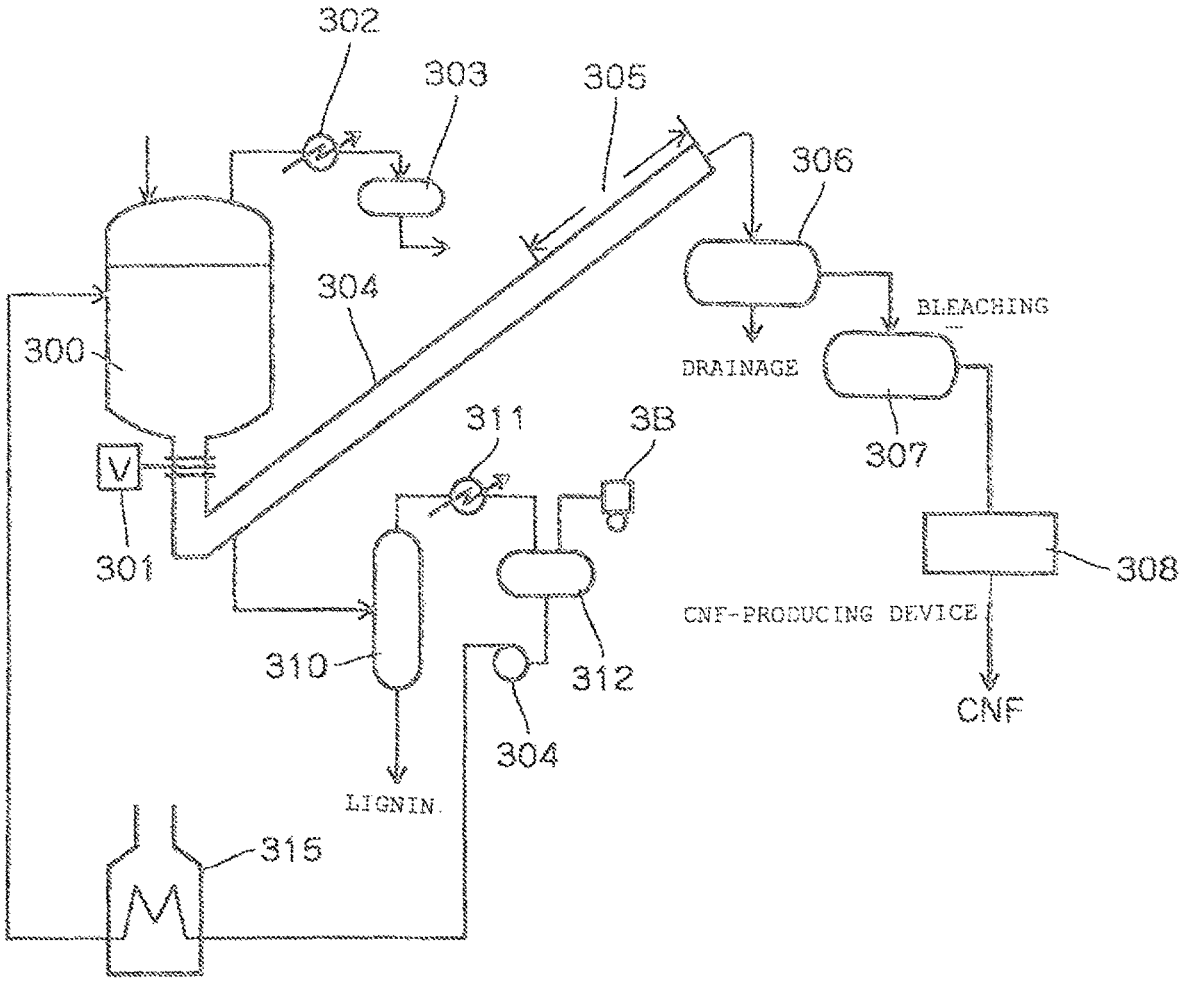
FIG. 4 is a view illustrating a third embodiment.

FIG. 4 illustrates a third embodiment and illustrates a continuous separation method. In a dissolution reservoir 300, tri-ethylene glycol (TEG) is stored as a separating agent.

An extraction portion of the separating agent is connected to a reservoir bottom of the dissolution reservoir 300, an on-off valve 301 is provided in the extraction portion, the dissolution reservoir is connected to a variable transfer device 304 such as a screw, the variable transfer device 304 is inclined, and a liquid-draining region 305 in which a roller or the like is used is provided on an upper end side of the variable transfer device. Liquid-drained crude cellulose is injected into a rotary cutting water reservoir 306, washed, cut, and thus becomes fine cellulose, the fine cellulose is sent to a bleaching reservoir 307, bleached using an aqueous solution of hypochlorous acid and caustic soda, and then turned into CNF using a CNF-producing device 308 configured of the same system as in the above-described embodiment.

Meanwhile, one or a plurality of wood-based raw materials selected from the group consisting of bamboo, wood, wood cotton, and cotton is intermittently injected into the dissolution reservoir 300, the vapor of a hemicellulose component is condensed using a condenser 302 and received in a receiving reservoir 303, and the pH of a condensate in the receiving reservoir 303 is monitored.

The separating agent is extracted from the lowest end side of the variable transfer device 304 and transferred to a vacuum evaporation tower 310, the separating agent is evaporated in a vacuum, lignin is separated and collected, the vacuum-evaporated separating agent is condensed using a condenser 311 and collected in a separating agent-collecting reservoir 312 in which a negative pressure is formed using a vacuum pump 313.

The separating agent in the separating agent-collecting reservoir 312 is extracted using a circulation pump 314, heated using a circulation heating portion 315, circulated to the dissolution reservoir 300, thereby heating the dissolution reservoir 300.

Next, the separation method will be described. Into the dissolution reservoir 300, a wood-based raw material such as bamboo is injected, and the separating agent in the dissolution reservoir 300 is heated. When the liquid temperature of the separating agent reaches a temperature in a range of 200° C. to 260° C., for example, 200° C., the hemicellulose component begins to evaporate, and the pH of a condensate thereof indicates a strong acidity. The pH of the condensate increases until 260° C. and reaches 5 to 6 at 275° C., the amount of the hemicellulose component distilled away decreases, when fractional distillation stops, the heating is stopped, and the condensate is held to stand at the temperature for 0.5 to 1.5 hours.

Next, the on-off valve 301 of the extraction portion of the dissolution reservoir 300 is opened, the separating agent is separated from the crude cellulose and extracted from the lowest end side of the variable transfer device 304, the separating agent is evaporated in a vacuum in the vacuum evaporation tower 310, lignin is separated and collected, the vacuum-evaporated separating agent is condensed using the condenser 311 and collected in the separating agent-collecting reservoir 312 in which a negative pressure is formed using the vacuum pump 313.

In the variable transfer device 304, the separated crude cellulose is washed and cut in the rotary cutting water reservoir 306, then, bleached in the bleaching reservoir 307, miniaturized, and then, turned into CNF.

The separating agent collected in the separating agent-collecting reservoir 312 is heated to a predetermined temperature in the circulation heating portion 315 and circulated to the dissolution reservoir 300, then, a wood-based raw material such as bamboo is injected therein, and the same work as described above is carried out, whereby the cellulose can be continuously separated and collected.

What is claimed is:

1. A method for separating cellulose from a wood-based raw material including hemicellulose, cellulose, and lignin as principal components, the method comprising the steps of:

injecting the wood-based raw material into a dissolution reservoir in which ethylene glycol is stored as a separating agent, and heating the separating agent in the dissolution reservoir at atmospheric pressure to a temperature in a range of 260° C. to 280° C., and reacting the wood-based raw material with the separating agent, evaporating a hemicellulose component from the separating agent and condensing the hemicellulose component, monitoring a pH value of the condensate of the hemicellulose component, wherein the pH value changes from an acidic value to a neutral value as a temperature of the separating agent increases, the temperature of the condensate is held at the temperature at which a change in the pH value of the condensate decreases, lignin is dissolved in the separating agent, and crude cellulose that floats in the separating agent is separated and collected.

2. The method for separating cellulose according to claim 1, wherein the step of reacting includes stirring the crude cellulose separated and collected from the separating agent and washing the crude cellulose by using a blade rotating in water and cutting the crude cellulose to obtain cut cellulose.

3. The method for separating cellulose according to claim 2, wherein the step of stirring includes bleaching the cut cellulose by being immersed in an aqueous solution of hypochlorous acid and caustic soda and miniaturized.

4. The method for separating cellulose according to claim 3, wherein the step of bleaching includes imparting a mechanical pressurizing force to the cut cellulose to be miniaturized.

* * * * *